US006405624B2

(12) United States Patent
Sutton

(10) Patent No.: US 6,405,624 B2
(45) **Date of Patent: *Jun. 18, 2002**

(54) SPLITTER AND CUTTING MEMBER GUARD ASSEMBLY

(75) Inventor: Stephen O. Sutton, Wexford, PA (US)

(73) Assignee: Delta International Machinery Corp., Jackson, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/111,980

(22) Filed: Jul. 8, 1998

(51) Int. Cl.[7] ..... B27B 27/04

(52) U.S. Cl. ..... 83/102.1; 83/477.2; 83/478; 83/860

(58) Field of Search ..... 83/102.1, 478, 83/477.2, 860, DIG. 1

(56) References Cited

U.S. PATENT DOCUMENTS

| | | | | |
|---|---|---|---|---|
| 1,244,187 A | * | 10/1917 | Frisbie | 83/860 |
| 1,258,961 A | * | 3/1918 | Tattersall | 83/102.1 |
| 1,430,983 A | * | 10/1922 | Granberg | 83/860 |
| 1,496,212 A | | 6/1924 | French | |
| 1,640,517 A | | 8/1927 | Procknow | |
| 1,774,521 A | | 9/1930 | Neighbour | |
| 2,007,887 A | | 7/1935 | Tautz | |
| 2,095,330 A | * | 10/1937 | Hedgpeth | 83/102.1 |
| 2,163,320 A | | 6/1939 | Hammond | |
| 2,352,235 A | | 6/1944 | Tautz | |
| 2,466,325 A | | 4/1949 | Ocenasek | |
| 2,593,596 A | | 4/1952 | Olson | |
| 2,623,555 A | * | 12/1952 | Eschenburg | 83/478 |
| 3,232,326 A | * | 2/1966 | Speer et al. | 83/102.1 |
| 3,754,493 A | | 8/1973 | Niehaus et al. | |
| 4,026,174 A | | 5/1977 | Fierro | |
| 4,206,672 A | | 6/1980 | Smith | |
| 4,343,213 A | * | 8/1982 | Drixler | 83/478 |
| 4,418,597 A | | 12/1983 | Krusemark et al. | |
| 4,625,604 A | | 12/1986 | Handler et al. | |
| 5,447,085 A | * | 9/1995 | Gochnauer | 83/102.1 |

OTHER PUBLICATIONS

Owner's Manual for Sears/Craftsman Model No. 113.298034 10–Inch Table Saw, dated Jan. 1991.

Parts Listing for Delta International Machinery 34–639 Blade Guard and 34–885 Uniguard® Blade Guard for 10 *Unisaws*® Table Saw, dated Nov. 7, 1995.

Instruction Manual for Delta International Machinery Unisaw® 10" Right Tilting Arbor Saw, dated Dec. 1, 1997.

Parts Listing for Delta International Machinery Unisaw®10" Tilting Arbor Right Tilt Table Saw, dated Oct. 23, 1997.

* cited by examiner

*Primary Examiner*—Allan N. Shoap
*Assistant Examiner*—Stephen Choi
(74) *Attorney, Agent, or Firm*—Kirkpatrick & Lockhart LLP

(57) ABSTRACT

A splitter and cutting member guard assembly for mounting on a table saw or other similarly constructed device including a circular saw blade or other rotating, oscillating, or otherwise driven cutting member, a table portion including a workpiece supporting surface and having a void therethrough for passage of a portion of the cutting member, and a table insert removably disposed within the void and including a slot for passage of the cutting member. The splitter and cutting member assembly includes a cutting member guard hood for covering an operative portion of the cutting member and a splitter for passing through a workpiece kerf as the workpiece is fed past the splitter. The cutting member guard hood is movably mounted to the splitter and is pivotable or otherwise movable relative to the splitter between a first position, in which the cutting member hood covers the operative portion of the cutting member, and a second position, in which the operative portion of the cutting member is not covered by the cutting member guard hood. The cutting member guard hood may be retained in the second position if the table insert is removed from the void in the table portion.

55 Claims, 7 Drawing Sheets

SPLITTER AND CUTTING MEMBER GUARD ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention relates to splitter and cutting member guard assemblies for table saws and other cutting devices including a rotating, oscillating, or otherwise driven cutting member that is at least partially surrounded by a workpiece support surface. More particularly, the present invention relates to splitter and cutting member guard assemblies wherein the cutting member guard hood may be disposed in at least two positions relative to the splitter of the assembly, and wherein the positions include a first position, in which the cutting member guard hood covers a portion of the cutting device's cutting member, and a second position, in which that portion of the cutting member is not covered by the cutting member guard hood and is accessible to an operator. The present invention finds application in any field in which it is desirable to prevent operator contact with a rotating, oscillating, or otherwise driven cutting member, but wherein certain operations, such as installation or replacement of the cutting member, require that the cutting member and its mounting point are accessible to an operator. Examples of possible fields of application of the present invention include the woodworking field as used with, for example, table saws, as well as in any field in which cutting devices of a generally similar construction are used to separate or otherwise remove a portion of a workpiece.

BACKGROUND OF THE INVENTION

In several fields, devices for cutting workpieces are known that include a substantially planar, generally horizontally disposed, workpiece support surface through which a portion of a rotating or oscillating cutting member is exposed. A familiar example is an electric table saw, which typically includes a table portion having a support surface for supporting a workpiece, a frame for supporting or bracing the table portion at an appropriate elevation, and a circular saw blade that is disposed through a void in the table portion so that an operative portion of the saw blade is disposed above the workpiece support surface and may contact and cut a workpiece advanced along the support surface. The "operative portion" of the saw blade is that portion of the saw blade that is disposed above the support surface and may contact and cut a workpiece advanced along the support surface. Table saws have included a saw blade guard hood for covering the operative portion of the saw blade to prevent operator contact with the saw blade and limit the ejection of cutting debris. Table saws have also included a splitter for entering into the workpiece kerf so as to reduce the possibility of workpiece binding as the workpiece is severed by the saw blade. The saw blade guard hood may be movably connected to the splitter to provide a splitter and saw blade guard assembly. The splitter portion of the assembly is fixedly connected to some portion of the table saw such as the table portion and/or frame, and is mounted in line with the saw blade. As the workpiece contacts the forward face of the saw blade guard hood the hood moves relative to the splitter and is forced upward allowing the workpiece to advance into the rotating saw blade. As the workpiece advances along the workpiece support surface past the saw blade, the splitter enters the kerf cut in the workpiece.

The circular saw blade of a table saw typically is mounted on a rotating spindle or arbor located beneath the table portion, and the spindle may be raised or lowered to appropriately adjust the elevation of the portion of the saw blade positioned above the workpiece support surface. In order to facilitate access to the arbor through the table portion so that the saw blade may be installed or replaced, the saw blade typically extends through a void in the table portion that is substantially wider and longer than the saw blade's cross-section. A table insert is disposed in the void when the table saw is in operation, and the table insert includes an appropriately sized slot through which the saw blade passes. To access the arbor through the table portion, the saw blade guard hood is removed or moved to allow access to the portion of the saw blade disposed above the workpiece support surface, and the table insert is then removed from the void in the table portion.

The ease by which an operator may access the arbor through the table portion is influenced by the particular construction of the splitter and saw blade guard assembly. In one known construction, shown in FIG. 6, a splitter and saw blade guard assembly 110 is fixedly connected to a table saw 111, shown in cross-section, along a line coincident with a longitudinal axis of the slot in the table insert, including a table portion 112 having a generally planar workpiece support surface 113, a frame 114 for supporting the table portion 112, and a rotating circular saw blade 116. The assembly 110 includes a splitter 118 having two posts 120 and 122 for fixedly connecting the splitter 118 to the table portion 112 and the frame 114, respectively. The splitter 118 is aligned with the saw blade 116 so that the splitter 118 enters the kerf of a workpiece (not shown) that has been cut by the saw blade 116 (advanced rightwardly in FIG. 6). The saw blade 116 passes through a table insert slot, the position of which is indicated generally as 126, and the table insert 117 is disposed in a void in the table portion 112. The assembly 110 also includes a saw blade guard hood 128 that is movably connected to the splitter 118 by a pivot member 130 that is, in turn, rotatably connected to the hood 128 at a first rotation point 132 and that is rotatably connected to the splitter 118 at a second rotation point 134. Suitable rotation of the pivot member 130 about on one or both rotation points 132 and 134 allows the hood 128 to assume a first position, wherein it covers the portion of the saw blade 116 disposed above the support surface 113, and a second position, wherein that portion of the saw blade 116 is not covered by the hood 128, and intermediate positions. FIG. 6 shows the second position, and the general direction of movement of the hood 128 from the first position to the second position is indicated by the curved arrow. The pivot member 130 is constructed so that it may not rotate about the second rotation axis 134 in the clockwise direction as depicted in FIG. 6 beyond the position shown in FIG. 6. Thus, the mass of the hood 128 causes the hood 128 to fall downward in the direction opposite to the curved arrow from the second position shown in FIG. 6 to the first position, and such movement would interfere with an operator's removal of the table insert 117 to, for example, access the arbor through the void table portion 112 to mount or replace the saw blade.

FIG. 7 depicts another existing splitter and saw blade guard assembly, generally designated as 210, for use with a table saw 211 and generally including a saw blade guard hood 212 movably connected to a splitter 214 by pivot member 216. As in FIG. 6, FIG. 7 shows the table saw 211 in cross-section along a longitudinal line through the slot in the saw's table insert 224. As in the assembly 110 depicted in FIG. 6, the pivot member 216 is rotatably connected to the hood 212 at a first rotation point 218 and to splitter 214 at a second rotation point 220. By rotating pivot member 216 about second rotation point 220 in the clockwise direction indicated by the arrow in FIG. 7, the hood 212 may be moved from a first position, in which the hood 212 is disposed over both the portion of the saw blade 222 disposed above the workpiece support surface 213 and the table insert 224 through which the saw blade 222 is disposed, and a second position, shown in FIG. 7, in which the operative portion of the saw blade 222 is uncovered and the table insert 224 may be removed from the void 228 in the saw's table portion 226 without interference from the hood 212. The assembly 210 is designed so that the pivot member 216 may rotate beyond the point that may be attained in the assembly 110 of FIG. 6, thereby allowing the hood 212 to be retained in the depicted second position by the force of gravity. Although the assembly 210 provides some advantage over assembly 110 of FIG. 6 in that the hood 212 of assembly 210 will remain in the second position and allow unhindered removal and re-installation of the table insert 224, an operator must manually rotate the hood 212 back to the first position from the second position after the table insert 224 has been re-installed in the void 228 and before operating the table saw 211.

Considering the limitations inherent in the known table saw splitter and saw blade guard assemblies, the need exists for an improved assembly. More generally, a need exists for an improved splitter and cutting member guard assembly for table saws and other cutting devices that include a rotating or oscillating cutting member having an operative portion that is at least partially surrounded by a workpiece support surface.

SUMMARY OF THE INVENTION

The present invention addresses the forgoing needs, among others, by providing an improved splitter and cutting member guard assembly. The assembly of the present invention is intended for mounting on a table saw or other similarly constructed device that includes a circular saw blade or other rotating or oscillating cutting member and that includes a workpiece support surface at least partially surrounding an operative portion of the cutting member. The assembly of the present invention includes (i) a cutting member guard hood for covering an operative portion of the cutting member and (ii) a splitter for passing through a workpiece kerf as the workpiece is fed past the splitter. The cutting member guard hood (which, when the assembly is constructed for use with a table saw, may be in the form of a saw blade guard hood) is movably mounted to the splitter and is pivotable or otherwise movable relative to the splitter between a first position, in which the cutting member hood covers the operative portion of the cutting member, and a second position, in which the operative portion of the cutting member is exposed. As such, the first and second positions may correspond to a raised position and lowered position, respectively, of the cutting member guard hood.

The assembly of the present invention is constructed so that the cutting member guard hood may be retained in the second position, which facilitates operator access to the saw blade, table insert, and, on removal of the table insert, arbor. To provide for retention of the hood in the second position, the assembly of the present invention may include first and second retention elements as follows: the cutting member guard hood may include a first retention element and the splitter may include a second retention element, and the retention elements may selectively co-act so as to connect the cutting member guard hood and the splitter, either directly or indirectly, to thereby retain the cutting member guard hood in the second position.

As used herein, the term "co-act" refers to the concerted action of the first and second retention elements, either by their engagement, coupling, linkage, etc., together, either directly or indirectly, so as to connect the cutting member guard hood to the splitter.

The splitter and cutting member guard assembly of the present invention may be constructed for attachment to a cutting device such as, for example, a table saw, wherein the cutting device includes a table portion, a void defined in the table portion, and a table insert disposed within the void, and wherein the table insert includes a slot therethrough through which the circular saw blade or other cutting member of the device may extend and that is removable from the table portion to provide an operator access through the table portion. In the assembly of the present invention, the table insert must be removed from the void in the table portion to allow the first retention element to co-act with the second retention element to thereby retain the cutting member guard hood in the second position.

The cutting member guard hood may be movably mounted to the splitter by, for example, a pivot assembly that is movably mounted to both the cutting member guard hood and the splitter and that allows the cutting member guard hood to assume both the first and second positions, as well as positions intermediate the first and second positions. In one configuration, the pivot assembly may include a pivot member having first and second ends. The first end is rotatably connected to the cutting member guard hood about a first axis of rotation and the second end is rotatably connected to the splitter about a second axis of rotation. The cutting member guard hood is movable between the first and second positions by rotating the pivot member about at least the second rotation axis relative to the splitter.

The splitter and cutting member guard assembly of the invention also may be constructed so that the cutting member guard hood is biased toward the first position. In one construction of the invention, the individual elements of the invention are configured and arranged so that the force of gravity acting upon the masses of the movable elements of the invention will urge the cutting member guard hood toward its first position.

The first retention element of the cutting member guard hood may be, for example, a projecting portion of the hood, such as a tab or other projection, and the second retention element of the splitter may be, for example, a first recess defined by the perimeter of the splitter. In that arrangement, the projecting portion of the hood may be disposed within the splitter's first recess when the cutting member guard hood is in the second position, and the engagement of the projecting portion and first recess will retain the hood in the second position unless disturbed. The splitter also may include a second recess, which also may be formed by the perimeter of the splitter, to receive the projecting portion of the cutting member guard hood when the hood is in the first position.

As indicated above, according to one aspect of the splitter and cutting member guard assembly of the present invention, the cutting member guard hood may not be placed into the second position, and cannot be retained in that position, unless the table insert has been removed from the void in the table portion of the cutting device. That aspect of the invention may be accomplished by, for example, defining a table insert plane which includes a surface of the table insert when the table insert is disposed within the void in the table portion of the cutting device. The cutting member guard hood is constructed and arranged so as to intersect the table insert plane and a region of the hood is disposed within the void in the table portion when the hood is in the second position, while the hood neither intersects the table insert plane nor is partially disposed within the void in the table portion when the hood is in the first position. Thus, the table insert of the cutting device must be removed from the void in order to, for example, allow engagement or other co-action of the first and second retention elements to retain the cutting member guard hood in the second position.

According to yet another aspect of the present invention, the invention is directed to a splitter and cutting member guard assembly for mounting on a cutting device having a rotating or reciprocating cutting member, a table portion having a workpiece support surface, a void defined in the table portion, and a removable table insert that is selectively positionable within the void and that includes a slot to allow at least a portion of the cutting member to protrude therethrough. The assembly includes a splitter for passing through a workpiece kerf and a cutting member guard hood for selectively covering an operative portion of the cutting member. (The cutting device may be, for example, a table saw, in which case the cutting member may be a circular saw blade and the cutting member guard hood may be a saw blade guard hood.) The cutting member guard hood is movably connected to the splitter and is positionable between a first position, in which the cutting member guard hood covers a portion of the cutting member exposed above the workpiece support surface, and a second position, in which the portion of the cutting member is not covered by the cutting member guard hood. A portion of the cutting member guard hood is selectively engageable, either directly or through intermediate elements, with a portion of the splitter to retain the hood in the said second position, and the hood is prevented from engaging the splitter to retain the hood in the second position if the table insert is positioned within the void in the table portion. For example, the assembly may be constructed so that a region of the cutting member guard hood is disposed in the void in the table portion when the cutting member guard hood is in the second position.

As indicated above, the splitter and cutting member guard assembly of the present invention may be adapted for use with a table saw including a circular saw blade. In such configuration, the assembly of the invention may be in the form of, for example, a splitter and saw blade guard assembly including (i) a circular saw blade guard hood for covering the operative portion of the circular saw blade which protrudes through the slot in the table insert of the table saw and (ii) a splitter for entering the workpiece kerf after the cut workpiece passes beyond the circular saw blade. The saw blade guard hood is movably connected to the splitter and is movable relative to the splitter between at least a first position, in which the saw blade guard hood covers the operative, protruding portion of the circular saw blade, and a second position, in which the operative portion of the circular saw blade is not covered by the saw blade guard hood. The saw blade guard hood is selectively engageable or otherwise connectable to the splitter, either directly or indirectly through intermediate elements, to thereby retain the saw blade guard hood in the second position. However, the saw blade guard hood may only be retained in the second position by the foregoing engagement of elements if the table saw insert has been removed from the void in the table saw's table portion, and this feature may be achieved by, for example, configuring the elements of the assembly so that the saw blade guard hood intersects the table insert plane when the hood is in the second position. Thus, the saw blade guard is thereby prevented from being retained in the second position when the table insert is positioned within the void in the table portion.

The present invention also is directed to a cutting device including a splitter and cutting member guard assembly constructed according to the present invention, and the cutting device also may include a rotating or reciprocating cutting member, a table portion having a workpiece supporting surface and also having a void therethrough for passage of a portion of the cutting member, a frame for supporting the table portion, and a table insert that is selectively positonable within the void and that includes a slot for passage of the cutting member therethrough. According to an aspect of the invention, the cutting device of the present invention may be, for example, a table saw having a cutting member in the form of a rotating circular saw blade and further including a splitter and cutting member guard assembly constructed according to the present invention and in the form of splitter and saw blade guard assembly.

According to a further aspect of the present invention, a cutting device in the form of a table saw constructed according to the present invention includes:

- a table portion having a void therethrough and including a support surface for supporting a workpiece;
- a frame on which the table portion is mounted;
- a table insert that is selectively positionable within the void and that includes a slot through which the table saw's circular saw blade may extend; and
- a splitter and saw blade guard assembly which may be, for example, directly or indirectly mounted to at least the frame and/or the table portion, including a saw blade guard hood, for covering an operative portion of the circular saw blade exposed above the table insert, and a splitter, and wherein the saw blade guard hood is movably mounted to the splitter and is movable relative to the splitter between a first position, in which the saw blade guard hood covers the operative portion of the circular saw blade protruding through the table insert, and a second position, in which the operative portion of the circular saw blade is not covered by the hood, and wherein the saw blade guard hood includes a first retention element that selectively may co-act, either directly or indirectly through intermediate elements, with a second retention element defined by the splitter, to thereby retain the saw blade guard hood in the second position, and further wherein the first retention element is incapable of co-acting with the second retention element to retain the saw blade guard in the second position when the table insert is positioned within the void in the table portion.

According to an additional aspect of the present invention, the invention provides for a cutting device in the form of a table saw including a rotating circular saw blade and further including:

- a table portion having a void therethrough and including a support surface for supporting a workpiece;

a frame on which the table portion is mounted;

a table insert that is selectively positionable within the void and that includes a slot through which the circular saw blade may extend; and a splitter and saw blade guard assembly, which may be, for example, mounted, either directly or indirectly through one or more intermediate elements, to at least the frame and/or the table portion, including a splitter for passing through a kerf cut in a workpiece by the circular saw blade and including a first retention structure thereon, and a saw blade guard hood, including a second retention structure thereon, for preventing an operator from contacting a portion of the circular saw blade, and wherein the saw blade guard hood is pivotally mounted to the splitter and is positionable in at least a first position, in which the saw blade guard hood covers a portion of the circular saw blade, and a second position, in which the portion of the circular saw blade is not covered by the saw blade guard hood, and further wherein one of the two retention structures may engage the other of the two retention structures to provide a retained configuration in which the saw blade guard hood is retained in the second position, and also wherein the retention structures are incapable of assuming the retained configuration when the table insert is positioned within the void in the table portion.

The splitter and cutting member guard assembly of the present invention provides an improvement over the existing assemblies. In particular, and as further described below, the splitter and cutting guard assembly of the present invention provides for retention of the cutting member guard hood in a position allowing operator access to the cutting member and the table insert so that the insert may be removed and the cutting member, both above and below the table insert, is conveniently accessible to an operator. The invention may be configured as necessary to adapt it to the particular application in which it is used and is useful in such adaptations as, for example, a splitter and saw blade guard member assembly for a table saw having a rotating circular saw blade or other rotating cutting member.

The reader will appreciate the foregoing details and advantages of the present invention, as well as others, upon consideration of the following detailed description of embodiments of the invention. The reader also may comprehend such additional details and advantages of the present invention upon using the invention.

BRIEF DESCRIPTION OF THE DRAWINGS

The features and advantages of the present invention may be better understood by reference to the accompanying drawings in which like reference numerals refer to like elements and in which.

DESCRIPTION OF EMBODIMENTS OF THE INVENTION

While the present invention is susceptible of embodiment in many different forms, this specification and the accompanying drawings disclose only some specific forms as examples of the invention. The invention is not intended to be limited to the embodiments so described, and the scope of the invention is provided in the appended claims.

For ease of description, the invention and devices to which it may be attached may be described herein in a normal operating position, and terms such as upper, lower, horizontal, proximal, distal, etc., may be used with reference to the normal operating position and the normal position of an operator using the invention on a device on which it is mounted. It will be understood, however, that the apparatus of the invention may be manufactured, stored, transported, used, and sold in orientations other than the positions described.

The splitter and cutting member guard assembly of the invention may be used with certain conventional components, of table saws or other cutting devices, and the details of those conventional components, although not fully described or illustrated herein, will be apparent to those having ordinary skill in the art and an understanding of the necessary functions of such components.

Figure 1:
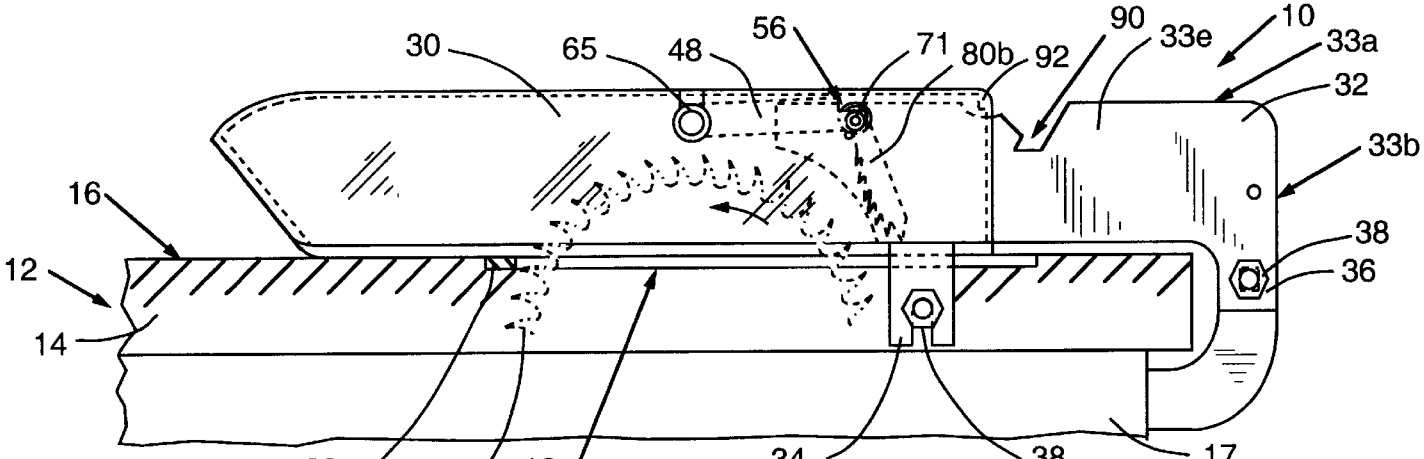
FIG. 1 is a side view of an embodiment of the splitter and cutting member guard assembly of the present invention depicted attached to a table saw and disposed in a position relative to the splitter in which the cutting member guard hood covers the operative portion of the saw blade.
Figure 2:
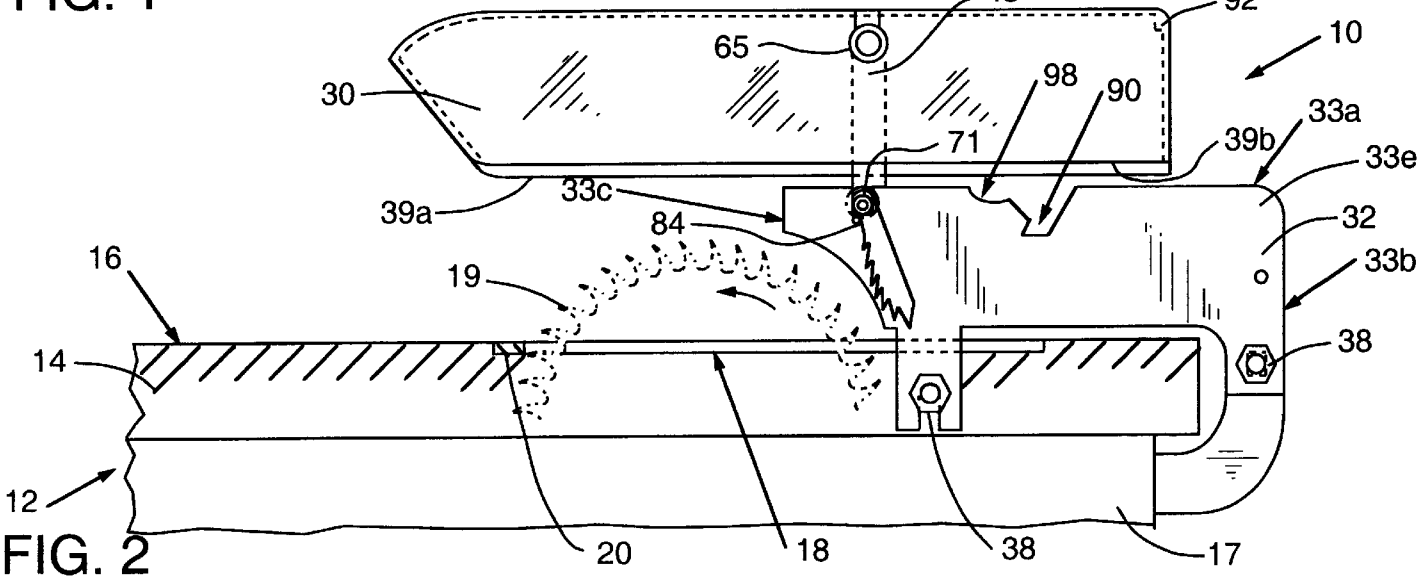
FIG. 2 is side view of the embodiment of the present invention shown in FIG. 1 depicted attached to a table saw and disposed in a position relative to the splitter in which the operative portion of the saw blade is not covered by the cutting member guard hood.
Figure 3:
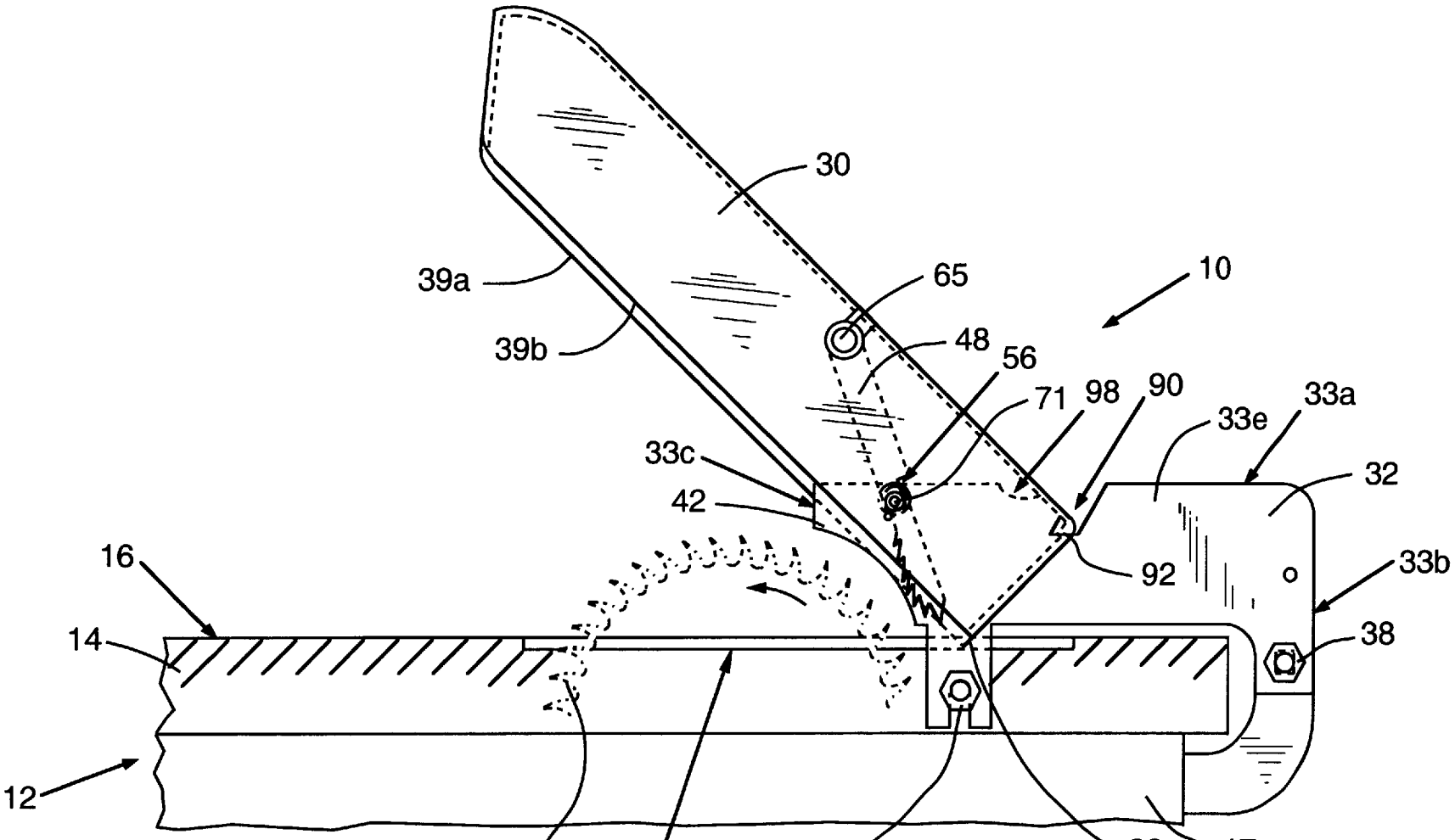
FIG. 3 is side view of the embodiment of the present invention shown in FIGS. 1 and 2 depicted attached to a table saw and disposed in a position in which a portion of the cutting member guard hood engages the splitter and thereby acts to retain the cutting member guard hood above the operative exposed portion of the saw blade.
Figure 4:
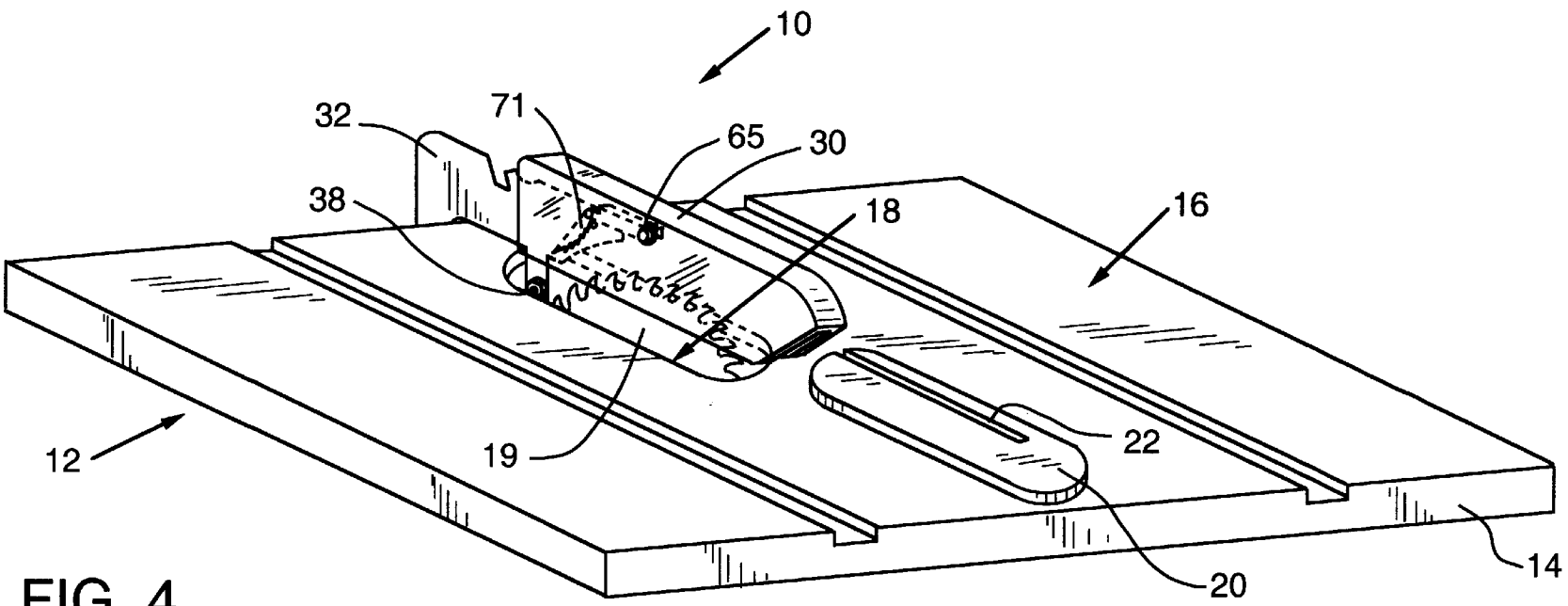
FIG. 4 is a perspective view depicting the embodiment of the present invention shown in FIGS. 1–3 depicted attached to a table saw with the table insert removed from the void in the table portion and disposed in the position relative to the splitter that is generally shown in FIG. 1.
Figure 5:
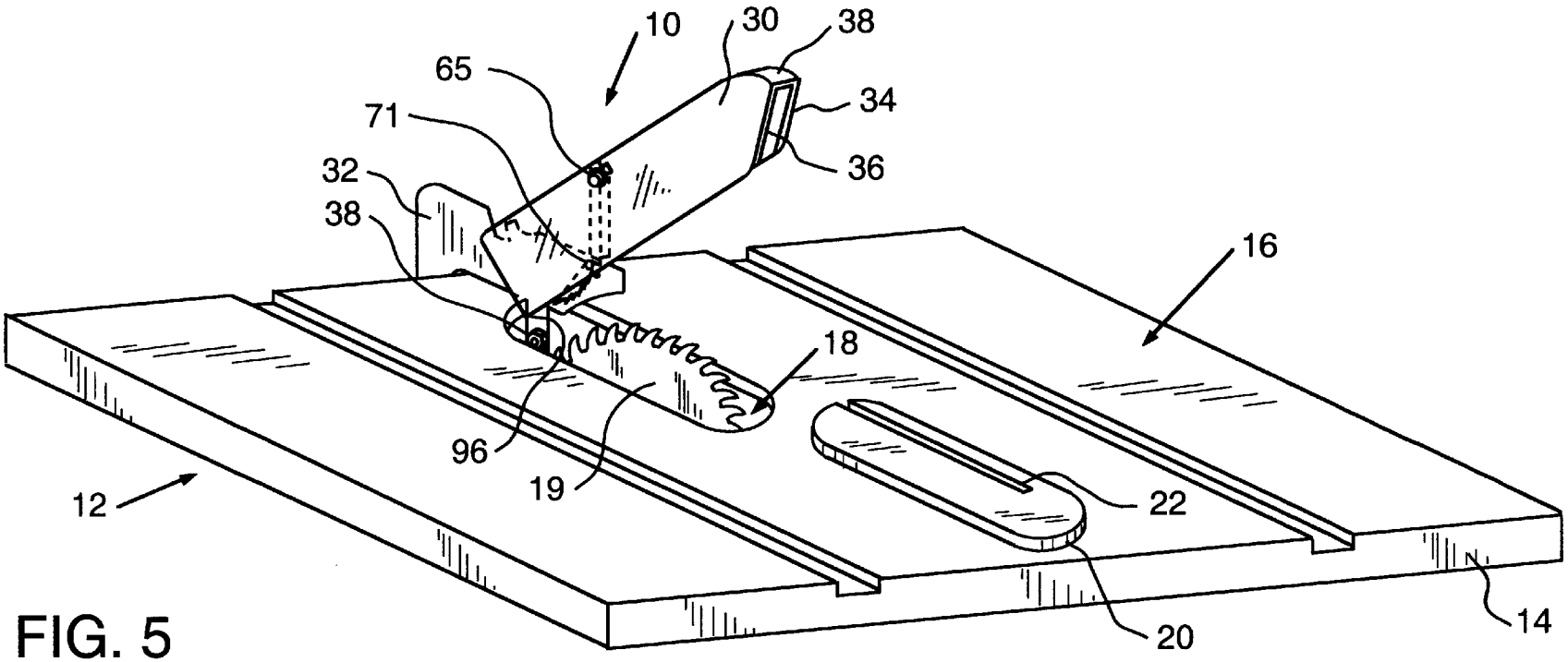
FIG. 5 is a perspective view depicting the embodiment of the present invention shown in FIGS. 1–3 depicted attached to a table saw with the table insert removed from the void in the table portion and disposed in the position relative to the splitter that is shown in FIG. 3.
Figure 6:
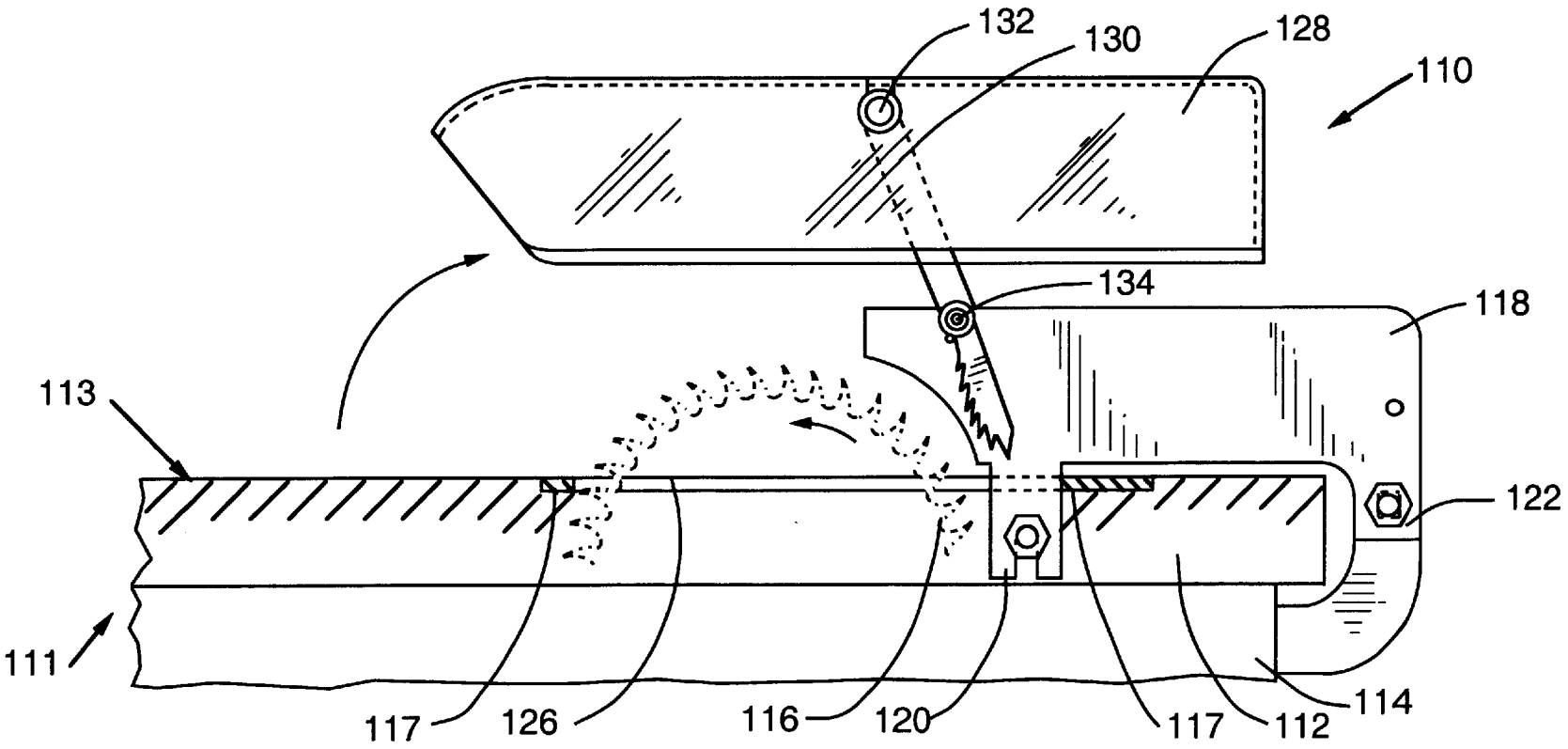
FIG. 6 PRIOR ART
FIGS. 6 and 7 are side views of prior art embodiments of splitter and saw blade guard assemblies shown attached to table saws.
Figure 7:
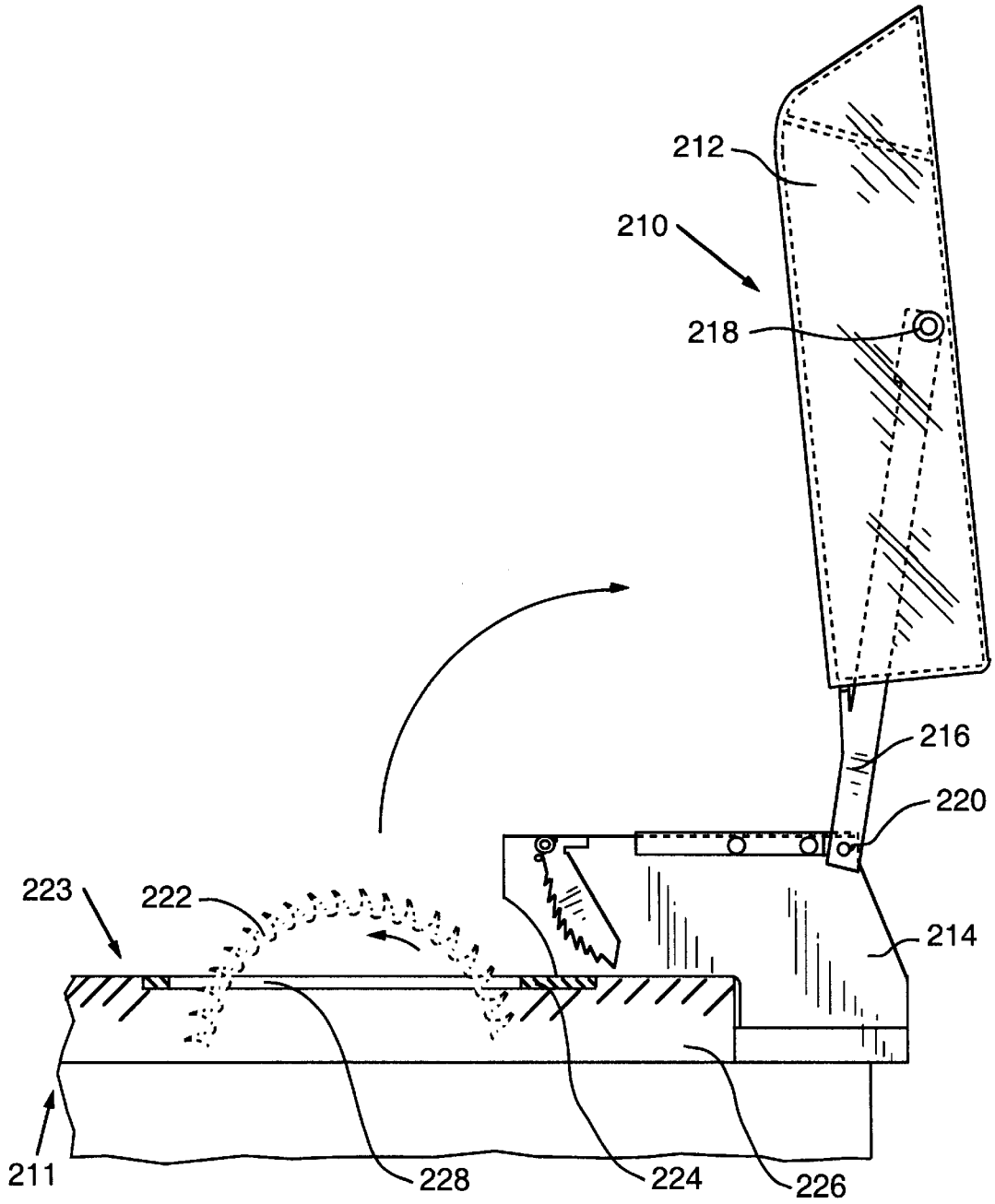
FIG. 7 PRIOR ART

Referring now to the drawings, which are for the purpose of illustrating an embodiment of the splitter and cutting member guard assembly of the invention and not for the purpose of limiting the same, a splitter and saw blade guard assembly 10 constructed in accordance with the present invention is generally illustrated in FIGS. 1–5 and 8. FIGS. 1–5, in particular, depict the assembly 10 mounted to a table saw 12 of a conventional design and including a table portion 14 having a workpiece support surface 16, a frame 17 for supporting or bracing the table portion 14 at a suitable elevation and in a suitable operating orientation, and a rotating circular saw blade 19 that is rotatably mounted on an arbor (not shown) disposed beneath the table portion 14. The saw blade 19 may be partially disposed through an elongate, generally elliptical void 18 in the work table 14 so as to provide an operative portion of the saw blade 19 above the workpiece support surface 16. As used in the present application, an "operative portion" of a saw blade or other cutting member is that portion of the cutting member that is disposed above the cutting device's workpiece support surface and that may contact and cut a workpiece advanced along the workpiece support surface. As best indicated in FIGS. 4 and 5 and as shown in cross section in FIGS. 1 and 2, a removable table insert 20 including a slot 22 for passage of the saw blade 16 therethrough is removably disposed within the void 18. It will be understood that, similar to FIGS. 6 and 7 described above, FIGS. 1 and 2 are cross-sections taken through the saw's work table 14 along a longitudinal axis of the void 18 and along the slot 22 in the table insert 20. In FIG. 3, the table insert 20 is removed and, therefore, the section of the proximal portion of the table insert 20 shown in FIGS. 1 and 2 is not shown in FIG. 3.

Although the assembly 10 is depicted in the appended figures mounted on a table saw, it will be understood that the use of the present invention is not so limited and, for example, an appropriately configured splitter and cutting member assembly of the present invention may be adapted for use with, for example, other devices having a rotating cutting member and a workpiece support surface at least partially surrounding the cutting member.

Figure 8:
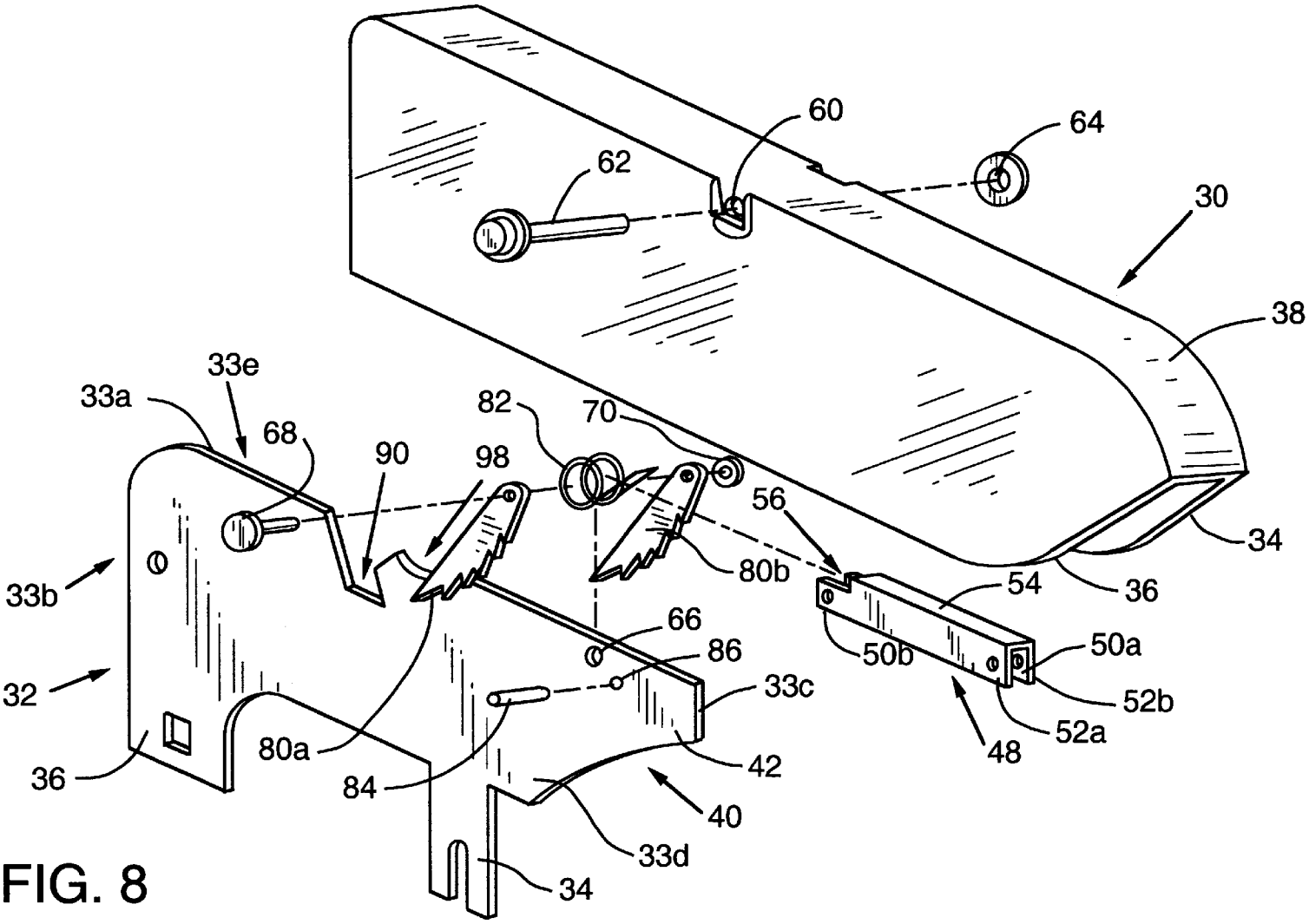
FIG. 8 is an assembly view of the embodiment of the present invention that is shown in FIGS. 1–5.

As best shown in FIG. 8, the assembly 10 includes a saw blade guard hood 30 and a splitter 32. The hood 30 protects the operator from contact with the rotating saw blade 19 (or other cutting member attached to the table saw) and in the present embodiment includes a first lateral wall 34, a second lateral wall 36, and a third wall 38 that connects the first and second lateral walls 34 and 36 in a spaced-apart relationship. The spacing between the first and second lateral walls 34 and 36 provides clearance for the operative portion of the saw blade 19, which is disposed above the workpiece support surface 16. The hood 30 may be constructed of any durable material such as, for example, a transparent polymeric material to allow an operator to view the cutting operation. In one configuration, shown in FIGS. 1–5 and 8, a first bottom edge 39*a* of the hood 30 extends beyond (is lower) than the hood's second bottom edge 39*b*. The splitter 32 is in the form of a plate of a durable material, such as steel, having at least a top, distal, and proximal edges 33*a*, 33*b* and 33*c*, respectively, first and second sides 33*d* and 33*e*, respectively, and a thickness sized to enter into the kerf of a workpiece that has been cut by the rotating saw blade 19. The splitter 32 includes two mounting structures 34 and 36 for mounting the splitter to the table saw 12. As shown in FIGS. 1–3, the mounting structures 34 and 36 are attached either directly or indirectly to the table portion 14 and/or the frame 17 of the table saw 14 by fasteners 38 so that the splitter 32 is properly aligned with the plane of the saw blade 19 and will be aligned with the workpiece kerf. Other manners of configuring the splitter 32 to provide for attachment to the table saw 14 will be apparent to those of skill in the art. The splitter 32 further includes an arcuate recess, indicated by 40, which provides clearance for the saw blade 19 and is formed by a projecting region 42 defined by the splitter's proximal edge 33*c*. In general, the splitter 32 inhibits binding of the workpiece as it is cut by the rotating cutting member and also provides a point of attachment for the hood 30 as described below. Although the present embodiment of the invention has the foregoing splitter construction, it will be understood that the splitter 32 may have any construction so that it provides a splitter function, establishes a point of rotational attachment for the hood 30, and may be mounted, either directly or indirectly, to the table saw table portion, frame, and/or other table saw elements in a suitable orientation relative to the saw blade.

The hood 30 is rotatably connected to the splitter 32 by a pivot assembly that may be in the form of a pivot member 48. As best shown in FIG. 8, pivot member 48 is an elongate member having first and second ends 50*a* and 50*b* and a generally U-shaped cross-section formed by opposed, co-extensive lateral walls 52*a* and 52*b* connected in a spaced-apart relationship by wall 54. Each of ends 50*a* and 50*b* includes a set of aligned bores formed in the lateral walls 52*a* and 52*b*. Wall 54 does not extend the length of the lateral walls 52*a* and 52*b* and thereby defines a notch, generally identified as 56, on second end 50*b*. The first end 50*a* of the pivot member is rotatably connected to hood 30 as follows. Pivot member 48 is disposed between the first and second lateral walls 34 and 36 of the hood 30 and the aligned set of bores in the first end 50*a* of pivot member 48 is aligned with a set of aligned bores (one indicated as 60 in FIG. 8) formed in the hood's first and second lateral walls 34 and 36. A fastener 62 is disposed through the four aligned bores and is secured therethrough by retainer 64. The fastener 62 forms a first rotation point, indicated in FIGS. 1–5 as 65, about which the pivot member 48 may rotate relative to the hood 30. The pivot member 48 is rotatably connected to the splitter 32 by interposing a bore 66, formed through the splitter 32, between the aligned bores in the second end 50*b* of the pivot member 48 and securing fastener 68 through the three aligned bores by retainer 70. The fastener 68 provides a second rotation point, indicated in FIGS. 1–5 as 71, about which the pivot member 48 may rotate relative to the splitter 32. The bore 66 in the splitter 32 is positioned so that the second end 50*b* of the pivot member 48 is connected at bore 66 in an orientation so that a portion of the top edge 33*a* that is located in the projecting region 42 of the splitter 32 may nest within the space formed between the lateral walls 52*a* and 52*b* of the pivot member, as indicated in FIG. 8.

As illustrated in FIG. 8, two workpiece kickback-inhibiting pawls 80*a* and 80*b*, having a construction known in the art, are rotatably attached about fastener 68 so as to flank the sides 33*d* and 33*e* of the splitter 32. A biasing member in the form of a spring 82 also may be provided about the fastener 68 and is constructed and arranged so as to bias the pawls 80*a* and 80*b* into an appropriate position, i.e., toward the operator and in the direction of the workpiece support surface 16 of the table saw 12. A pin 84 is mounted in a bore 86 provided through the splitter 32 and is positioned and dimensioned so as to protrude outward from the splitter 32 within the arc of rotation of the pawls 80*a* and 80*b* about the pin 84 so as to prevent the pawls 80*a* and 80*b* from rotating toward the operator beyond the position shown in FIGS. 1–3. The arrangement, construction, and mounting of the pawls 80*a* and 80*b*, spring 82, and pin 84 are conventional (see, for example, FIGS. 6 and 7) and, therefore, details of those elements are known to those of ordinary skill in the art and are not provided herein.

As illustrated in FIGS. 1–5, pivot member 48 is dimensioned, and the first and second rotation points 65 and 71 are disposed on the hood 30 and the splitter 32, respectively, so that the hood 30 may assume several positions relative to the splitter 32 and the saw blade 19. In a "first" position of the hood 30, shown in FIGS. 1 and 4, the pivot member 48 has been rotated about the first and second rotation points 65 and 71 so that the hood 30 is in an extreme lowered position and covers the operative portion of the saw blade 19, which is exposed above the workpiece support surface 16 of the saw's table portion 14. In the hood's first position, the pivot member 48 has been rotated about the second rotation point 71 as far as possible in the counter-clockwise direction (from the perspective shown in FIG. 1) and the first bottom edge 39*a* of the hood 30 contacts the table insert 20, extending completely over the slot 22 in the table insert, and also contacts the table portion 14. The table insert 20 is shown in FIG. 4 removed from the void 18 in the table portion 14 and is disposed on the workpiece support surface 16 only in order to show in greater detail the mounting arrangement of the splitter 32 and the disposition of the saw blade 19 through the void 18. During operation of the table saw 12 the table insert 20 will be in place within the void 18 for at least the reason that the table insert 20 will inhibit the workpiece, or portions thereof, from entering the void 18 and binding the saw blade 19.

The pivot member 48 may be rotated about the second point of rotation 71 from the extreme position shown in FIG. 1 to the opposite extreme position shown in FIG. 2. In the position of FIG. 2, the notch 56 formed by an end of the wall 54 of the pivot member 48 abuts the top edge 33*a* of the splitter 32 and prevents further rotation of the pivot member 48 about point 71. Although the hood 30 is shown in a generally horizontal orientation in FIG. 1, it will be understood that the hood 30 may pivot about the first rotation point 65, and the hood 30 is shown in the generally horizontal position only to better expose the elements of the assembly 10.

The pivot member 48 may be constructed so as to provide for the biasing of the hood 30 from the position shown in FIG. 3 (or from any other position of angular orientation about the second rotation point 71 intermediate the positions of FIG. 1 and FIG. 4) back toward the position shown in FIG. 1. In the present embodiment of the assembly 10, for example, the pivot member 48 may not rotate about the second point of rotation 71 from the position shown in FIG. 2 beyond a position at which a longitudinal axis of the pivot member 48 is generally vertically oriented. The distribution of the mass of the various regions of the hood 30 about the first rotation point 65 is such that gravity biases the hood 30 to rotate about the second rotation point 71 toward the first position. Thus, in assembly 10, the range of angular rotation of the pivot member 48 about the second rotation point 71 is generally limited to about ninety degrees.

The assembly 10 of the present invention also may assume a "second" position, in which the hood 30 is retained in an orientation relative to the splitter 32 wherein the hood 30 is not disposed on the table insert 20 or table portion 14 and further wherein the operative portion of the saw blade 19, which is disposed above the workpiece support surface 16, is not covered by the hood 30. The second position facilitates an operator's removal of the table insert 20 and his or her access to the arbor through the void 18 for replacement or removal of the saw's circular saw blade 19 or other cutting member. The hood 30 may be retained in the second position by retention elements or structures that are disposed on or defined by the hood 30 and the splitter 32. The retention elements may co-act (as further defined herein) to retain the hood in the second position, but, as described below, may only co-act if the table insert 20 has been removed from the void 18 in the table portion 14.

In the present embodiment 10, as best shown in FIG. 8 and FIG. 1, the hood 30 includes a first retention element in the form of a projection 92 disposed internally at a corner of the hood 30 and formed by a projecting portion of the interior surface of the third wall 38 between the lateral walls 34 and 36. The splitter 32 includes a second retention element in the form of an angled first recess 90 defined by the top edge 33*a* of the splitter 32. As illustrated in FIG. 3 and FIG. 5, in the hood's second position the projection 92 co-acts with the first recess 90 by being disposed within the first recess 90, and the construction of the projection 92 and first recess 90 and the arrangement of the assembly's elements are such that the hood 30 will maintain the second position unless disturbed. However, as further indicated by FIG. 3, the projection 92 may only engage the first recess 90 to thereby retain the hood 30 in the second position if the table insert 20 has been removed from the void 18 in the table portion 14. FIG. 3 shows that in the second position the rear bottom corner 96 of the bottom edge 39*a* of the hood 30 is disposed within the void 18 in the table portion 14 and intersects a table insert plane that is defined by the top surface of the table insert 20 when the table insert 20 is disposed in the void 18. Therefore, the hood 30 may only co-act with the splitter 32 so as to assume the second position if the hood 30 intersects the table insert plane and a region of the hood 30 (the rear bottom corner 96) is disposed within the void 18, which requires that the table insert 20 be removed from the void 18. Unless the table insert 20 has been removed from the void 18, the previously described arrangement of the elements of assembly 10 will cause the hood 30 to rotate to the first position unless acted upon by outside forces.

It will be understood that the manner by which the first and second retention elements of the assembly 10 described herein co-act is only one example thereof, and that any other arrangement or construction of the hood 30 and splitter 32 elements of the assembly 10 of the invention may be provided to allow for co-action of those elements so as to retain the hood 30 element in the second position. For example, the first retention element may be a recess within the hood 30 that may engage a projection formed on the splitter 32. The retention elements also may each be projections that may engage or otherwise couple to retain the hood 30 in the second position. Once apprised of the general construction of the present invention as described herein, those of ordinary skill in the art will comprehend additional possible constructions of the first and second retention elements and additional manners by which the hood and splitter 32 may co-act. It is intended that all such additional constructions are encompassed by the present invention as described in the appended claims.

In addition, although the present embodiment 10 is constructed so that the rear bottom corner 96 of the lower edge 39*a* of the hood 30 is disposed within the void 18 when the hood 30 assumes the second position, other constructions providing a like feature are possible. As an example, a projection may be provided on the hood 30 that will enter the void 18 when the hood 30 assumes the second position but that will be disposed outside the void 18 when the hood 30 is in the first position. Other possible constructions will be apparent to those of ordinary skill on considering the present description of the invention, and such alternate constructions are intended to be encompassed by the appended claims.

Referring again to FIGS. 3 and 5, it will be understood that when the table insert 20 is reinserted into the void 18, the insert 20 will contact the hood 30 in vicinity of the rear bottom corner 96 and will force the first retention element (projection 92) out of engagement with the second retention element (first recess 90), and the hood 30 will automatically rotate to the first position without manipulation by the operator. As long as the hood 30 of the present invention includes some portion or element that is suitably disposed within the void 18 when the hood 30 is retained in the second position, the hood 30 will be forced from the second position on replacing the table insert 20 back into the void 18. Thus, a feature of the present invention is that it may be configured to automatically free the cutting member guard hood 30 from the second position when the table insert 20 is re-installed.

A second recess 98 is provided in the top edge 33*a* of the splitter 32 for disposition of the projection 92 when the hood 30 is in the first position (see FIG. 1 and FIG. 2). Depending upon the form in which the first retention element is provided, the second recess 98 or a like element to house the first retention element when the hood 30 is in the first position may or may not be necessary.

The assembly 10 provides convenience to an operator in that the hood 30 may be retained in a position allowing access to the table insert 20, the saw blade 19 or other cutting element, and, when the table insert 20 is removed, to the arbor through the void 18. The hood 30 need not be manually held upward by the operator or, alternatively, the splitter and cutting member guard assembly need not be removed from the table saw in order to allow removal of the table insert or access to the saw blade or table saw arbor. Thus, the assembly of the present invention thereby improves upon the design of the splitter and cutting member guard assembly depicted in FIG. 6 and described above, which does not provide for retention of the saw blade guard hood in a position akin to the second position of FIG. 3. The assembly of the present invention also improves upon the construction of the assembly depicted in FIG. 7 and described above, which requires manual manipulation of the hood to move the hood from a retained position, in which the operative portion of the saw blade is uncovered by the hood (shown in FIG. 7), to a position at which that the hood covers the operative portion of the saw blade and is disposed on the table insert. In contrast, the assembly of the present invention automatically frees the saw blade guard hood from the retained position when the table insert is re-installed into the void in the table portion of the saw, and the hood is then urged to assume its first position.

Thus, the splitter and cutting member guard assembly 10 provides for an improvement over the foregoing existing designs. Although not specifically disclosed in detail herein, each of the elements of the assembly of the present invention may be constructed of a material appropriate for its particular application. For example, the cutting member guard hood may be fabricated from the above-mentioned transparent polymeric material as is known in the art, while the several remaining elements may be fabricated from steel or another appropriate iron-based alloy. Applications differing from that of the foregoing embodiment may require the use of other materials.

Although the foregoing description of an embodiment of the invention has specific application as a splitter and cutting member assembly mounted on a table saw having a rotating circular saw blade, an appropriately configured embodiment of the present invention may be employed in any environment wherein it is desirable to provide a rotating or reciprocating cutting member guard that is movably connected to a splitter positioned in line with the cutting member. Those of ordinary skill in the art will appreciate that various changes in the configurations, details, materials, and arrangement of the elements that have been herein described and illustrated in order to explain the nature of the invention may be made by those skilled in the art, and all such modifications will remain within the principle and scope of the invention as expressed herein in the appended claims.

What is claim is:

1. A splitter and cutting member guard assembly for mounting on a cutting device including a cutting member, a table portion, a void defined by said table portion, and a table insert removably disposed in the void, the splitter and cutting member guard assembly comprising:

a splitter comprising a second retention element; and a cutting member guard hood comprising a first retention element, wherein said cutting member guard hood is movably mounted to said splitter and pivotable between a first position, in which said cutting member guard hood covers an operative portion of the cutting member, and a second position, in which the operative portion of the cutting member is not covered by said cutting member guard hood and wherein when said cutting member guard hood is in said second position, said second retention element releasably retainingly engages said first retention element to thereby retain said cutting member guard hood in said second position, and wherein when the table insert is disposed in the void, said first retention element is prevented from retainingly engaging said second retention element.

2. The splitter and cutting member guard assembly of claim 1 wherein said first position corresponds to a lowered postion of said cutting member guard hood and said second position corresponds to a raised position of said cutting member guard hood.

3. The splitter and cutting member guard assembly of claim 1 wherein said cutting member guard hood is pivotally mounted to said splitter by a pivot assembly connected to both said cutting member guard hood and said splitter.

4. The splitter and cutting member guard assembly of claim 3 wherein gravity biases said cutting member guard hood to said first position.

5. The splitter and cutting member guard assembly of claim 4 wherein said pivot assembly comprises a pivot member having first and second ends wherein said first end is rotatably connected to said cutting member guard hood about a first axis of rotation and said second end is rotatably connected to said splitter about a second axis of rotation.

6. The splitter and cutting member guard assembly of claim 5 wherein rotation of said pivot member about said second axis is limited to less than 90°.

7. The splitter and cutting member guard assembly of claim 1 wherein said first retention element comprises a projecting portion and said second retention element comprises a first recess, and wherein with said cutting member guard hood in said second position, said projecting portion is disposed within said first recess.

8. The splitter and cutting member guard assembly of claim 7 wherein said cutting member guard hood is biased to said first position.

9. The splitter and cutting member guard assembly of claim 8 wherein gravity biases said cutting member guard hood toward said first position.

10. The splitter and cutting member guard assembly of claim 9 wherein said first position corresponds to a lowered position of said cutting member guard hood and said second position corresponds to a raised position of said cutting member guard hood.

11. The splitter and cutting member guard assembly of claim 7 wherein said splitter further comprising a second recess, and wherein with said cutting member guard hood in said first position, said projecting portion is disposed within said second recess.

12. The splitter and cutting member guard assembly of claim 7 wherein said cutting member guard hood comprises a first lateral wall, a second lateral wall, and a third wall connecting said first lateral wall and said second lateral wall in a spaced-apart relationship, and said third wall comprising said projecting portion, and wherein said projecting portion is a projecting tab.

13. The splitter and cutting member guard assembly of claim 12 wherein said splitter comprises a plate having an edge and said edge includes said first recess.

14. The splitter and cutting member guard assembly of claim 13 wherein said edge of said splitter further includes an arcuate recess; the assembly further comprising at least one workpiece-gripping member pivotally mounted to said splitter about said first axis of rotation and disposed between said plate and one of said first and second lateral walls of said cutting member guard hood.

15. The splitter and cutting member guard assembly of claim 1 wherein said splitter comprises at least one attachment member, said attachment member attaching said splitter to the cutting device.

16. A cutting device comprising:

a driven cutting member;

a table portion;

a void defined in the table portion, a removable table insert selectively positionable within the void;

a splitter and cutting member guard assembly, the splitter and cutting member guard assembly comprising:

a cutting member guard hood; and a splitter, said cutting member guard hood movably mounted to a connection portion of said splitter and pivotable between a first position, in which said cutting member guard hood covers an operative portion of the cutting member, and a second position, in which the operative portion of the cutting member is not covered by said cutting member guard hood, said cutting member guard hood having a retention element that releasably retainingly engages a corresponding retention portion of said splitter when said cutting member guard hood is in said second position to thereby retain said cutting member guard hood in said second position, and wherein with the table insert positioned within said void, said retention element is prevented from retainingly engaging said corresponding retention portion of said splitter.

17. A splitter and cutting member guard assembly for mounting on a cutting device having a cutting device further including a table portion, a void defined in the table portion, and a removable table insert selectively positionable within the void and including a cutting member slot, the assembly comprising:

a splitter; and a cutting member guard hood, said cutting member guard hood movably connected to a connection portion of said splitter and positionable between a first position, in which said cutting member guard hood covers a portion of the circular cutting member, and a second position, in which the portion of the circular cutting member is not covered by the cutting member guard hood, a retention portion of said cutting member guard hood releasably retainingly engaging a corresponding retention portion of said splitter to thereby retain said cutting member guard hood in said second position, said retention portion of said cutting member guard hood prevented from selectively engaging said corresponding retention portion of said splitter when the table insert is positioned within the void in the table portion.

18. The splitter and cutting member guard assembly of claim 17 wherein said retention portion of said cutting member guard hood is a projecting tab and said corresponding retention portion of said splitter is a notch in a perimeter of said splitter.

19. The splitter and cutting member guard assembly of claim 17 wherein said cutting member guard hood is biased to assume said first position.

20. The splitter and cutting member guard assembly of claim 17 wherein another portion of said cutting member guard hood extends into the void of the table portion when said cutting member guard hood is in said second position.

21. A splitter and cutting member guard assembly for mounting on a cutting device having a driven cutting member, the cutting device further including a table portion, a void in the table portion, and a removable table insert removably positioned within the void and including a cutting member slot, the assembly comprising a splitter for passing through a workpiece kerf and a cutting member guard hood, said cutting member guard hood movably connected to a connection portion of said splitter and positionable between a first position, in which said cutting member guard hood covers an operative portion of the cutting member, and a second position, in which the operative portion of the cutting member is not covered by the cutting member guard hood, wherein when said cutting member guard hood is in said second position, a retention portion of said cutting member guard hood releasably retainingly engages a corresponding retention portion of said splitter to thereby retain said cutting member guard hood in said second position, another portion of said cutting member guard hood positioned within the void in the table portion when said cutting member guard hood is in said second position, wherein when the table insert is positioned within said void, said retention portion of said cutting member guard hood is prevented from retainingly engaging said corresponding retention portion of said splitter.

22. The splitter and cutting member guard assembly of claim 21 wherein said retention portion of said cutting member guard hood includes a projecting tab and wherein said corresponding retention portion of said splitter includes a notch, said projecting tab engaging said notch only when the table insert is removed from the void in the table portion.

23. The splitter and cutting member guard assembly of claim 22 wherein said cutting member guard hood is biased to assume said first position.

24. A cutting device comprising:

a driven cutting member;

a table portion;

a void in the table portion; a removable table insert in the void; and a splitter and cutting member guard assembly having the construction recited in claim 21.

25. A splitter and cutting member guard assembly for mounting on a cutting device a driven cutting member, the cutting device further including a table portion with a surface defining a table surface plane, a void in the table portion, and a removable table insert positioned within the void and including a cutting member slot, a surface of the table insert being within the table surface plane when the table insert is positioned within the void, the assembly comprising a splitter and a cutting member guard hood, said cutting member guard hood pivotally connected to a connection portion of said splitter and movable relative to said splitter between a first position, in which said cutting member guard hood covers an operative portion of the driven cutting member, and a second position, in which the operative portion of the driven cutting member is not covered by the cutting member guard hood, and wherein when said cutting member guard hood is in said second position, a retention portion of said cutting member guard hood releasably retainingly engages a corresponding retention portion of said splitter to thereby retain said cutting member guard hood in said second position, said cutting member guard hood extending through the table surface plane into the void when said cutting member guard hood is in said second position, said retention portion of said cutting member guard hood thereby being prevented from retainingly engaging said corresponding retention portion of said splitter when the table insert is positioned within the void in the table portion.

26. A cutting device comprising:

a driven cutting member;

a table portion defining a table surface plane;

a void in the table portion, a removable table insert positioned within the void and including a cutting member slot, a surface of the table insert being within the table surface plane when the table insert is positioned within the void; and a splitter and cutting member guard assembly having the construction recited in claim 25.

27. A cutting device comprising:

a table portion having a void therethrough and including a workpiece support surface;

a frame, said table portion mounted on said frame;

a table insert removably supported within said void and including a slot through which a driven cutting member extends; and a splitter and cutting member guard assembly mounted to the cutting device, said splitter and cutting member guard assembly comprising a cutting member guard hood and a splitter said cutting member guard hood pivotally connected to said splitter and pivotable between a first position, in which said cutting member guard hood covers an operative portion of the cutting member, and a second position, in which the operative portion of the cutting member is exposed, said cutting member guard hood having a first retention element that releasably retainingly engages a second retention element on said splitter to thereby retain said cutting member guard hood in said second position, said first retention element prevented from retainingly engaging said second retention element to thereby retain said cutting member guard hood in said second position when said table insert is positioned within said void in said table portion.

28. The cutting device of claim 27 wherein said first position corresponds to a lowered position of said cutting member guard hood and said second position corresponds to a raised position of said cutting member guard hood.

29. The cutting device of claim 28 wherein said cutting member guard hood is connected to said splitter by a pivot assembly that is pivotally mounted to both said cutting member guard hood and said splitter.

30. The splitter and cutting member guard assembly of claim 29 wherein gravity biases said cutting member guard hood to assume said first position.

31. The cutting device of claim 29 wherein said pivot assembly comprises a pivot member having first and second ends wherein said first end is rotatably connected to said cutting member guard hood about a first axis of rotation and said second end is rotatably connected to said splitter about a second axis of rotation, said cutting member guard hood pivotable between said first position and said second position by rotating said pivot member about said second axis of rotation relative to said splitter.

32. The cutting device of claim 31 wherein said pivot member defines a longitudinal axis, and wherein an angle defined by a first orientation of said longitudinal axis at which said cutting member guard hood is in said first position and a second orientation of said longitudinal axis wherein said pivot member is in an extreme rotated position, is less than 90 degrees.

33. The cutting device of claim 27 wherein said first retention element comprises a projecting portion of said cutting member guard hood and said second retention element comprises a first recess, said projecting portion being disposed within said first recess when said cutting member guard hood is in said second position to thereby retain said cutting member guard hood in said second position.

34. The cutting device of claim 33 wherein said cutting member guard hood is biased toward said first position.

35. The cutting device of claim 34 wherein gravity biases said cutting member guard hood toward said first position.

36. The cutting device of claim 35 wherein said first position corresponds to a lowered position of said cutting member guard hood and said second position corresponds to a raised position of said cutting member guard hood.

37. The cutting device of claim 33 wherein said splitter further defines a second recess, and wherein said projecting portion of said cutting member guard hood is disposed within said second recess when said cutting member guard hood is in said second position.

38. The cutting device of claim 27 wherein said cutting member guard hood extends over said slot in said table insert when said cutting member guard hood is in said first position.

39. The cutting device of claim 38 wherein when said table insert is disposed with said void in said table portion a surface of said table insert is within said table insert plane, said cutting member guard hood intersecting said table insert plane and another portion of said cutting member guard hood being disposed within said void in said table portion when said cutting member guard hood is in said second position, said another portion of said cutting member guard hood disposed outside of said void in said table portion when said cutting member guard hood is in said first position.

40. The cutting device of claim 39 wherein said cutting member guard hood comprises a first lateral wall, a second lateral wall, and a third wall connecting said first lateral wall and said second lateral wall in a spaced-apart relationship, and wherein said region of said cutting member guard hood is a portion of at least one of said first lateral wall and said second lateral wall.

41. The cutting device of claim 37 wherein said cutting member guard hood comprises a first lateral wall, a second lateral wall, and a third wall connecting said first lateral wall and said second lateral wall in a spaced-apart relationship, and wherein said projecting portion is a projecting tab defined between said first and second lateral walls and defined by at least a portion of said third wall.

42. The cutting device of claim 41 wherein said splitter comprises a plate having at least top, distal, and proximal edges, and wherein said second retention element is a recess defined by said top edge.

43. The cutting device of claim 42 wherein a first axis of rotation passes through and is generally perpendicular to said plate.

44. The cutting device of claim 43 wherein said splitter of said splitter and cutting member guard assembly includes an arcuate recess, said splitter and cutting member guard assembly comprising at least one workpiece-gripping pawl pivotally mounted to said splitter about said first axis of rotation and between said plate and one of said first and second lateral walls of said cutting member guard hood, said splitter and cutting member guard assembly further comprising a spring, said spring biasing said pawl toward said support surface.

45. A cutting device comprising:

a table portion having a void therethrough and including a workpiece support surface;

a frame, said table portion mounted on said frame;

a table insert removably supported within said void and including a slot through which a driven cutting member extends; and a splitter and cutting member guard assembly mounted to at least one of said frame and said table portion, said splitter and cutting member guard assembly comprising a splitter and a cutting member guard hood, said cutting member guard hood movably connected to a connection portion of said splitter and positionable in a first position, in which said cutting member guard hood covers an operative portion of the cutting member, and a second position, in which the operative portion of the cutting member is not covered by the cutting member guard hood, and wherein when said cutting member guard hood is in said second position a retention portion of said cutting member guard hood releasably retainingly engages a corresponding retention portion of said splitter to thereby retain said cutting member guard hood in said second position, said retention portion of said cutting member guard hood being prevented from selectively engaging said corresponding retention portion of said splitter to retain said cutting member guard hood in said second position when said table insert is positioned within said void in said table portion.

46. The cutting device of claim 45 wherein said retention portion of said cutting member guard hood is a projecting tab and said corresponding retention portion of said splitter is a notch in a perimeter of said splitter.

47. The cutting device of claim 45 wherein when said cutting member guard hood is biased to assume said first position.

48. The cutting device of claim 46 wherein another portion of said cutting member guard hood is disposed within said table portion when said cutting member guard hood is in said second position.

49. A cutting device comprising:

a table portion having a void therethrough and including a workpiece support surface;

a frame, said table portion mounted on said frame;

a table insert removably supported within said void and including a slot through which a driven cutting member extends; and a splitter and cutting member guard assembly mounted to the cutting device, said splitter and cutting member guard assembly comprising:

a splitter including a first retention structure thereon; and a cuttting member guard hood movably mounted to said splitter and positionable in at least a first position, in which said cutting member guard hood covers the operative portion of the cutting member, and a second position, in which the operative portion of the cutting member is not covered by the cutting member guard hood, said cutting member guard hood including a second retention structure thereon, one of said first retention structure and said second retention structure releasably retainingly engaging the other of said first retention structure and said second retention structure when said cutting member guard hood is in said second position, said first retention structure and said second retention structure incapable of retainingly engaging each other when said table insert is positioned within said void in said table portion.

50. A cutting device comprising:

a table portion having a void therethrough and including a workpiece support surface;

a frame, said table portion mounted on said frame;

a table insert removably supported within said void and including a slot through which a driven cutting member extend; and a splitter and cutting member guard assembly mounted on the cutting device, said splitter and cutting member guard assembly comprising a splitter and a cutting member guard hood, said cutting member guard hood pivotally connected to a connection portion of said splitter and positionable between a first position, in which said cutting member guard hood covers the operative portion of the cutting member, and a second position, in which the operative portion of the cutting member is not covered by the cutting member guard hood, and wherein when said cutting member guard hood is in said second position, a retention portion of said cutting member guard hood releasably retainingly engages a corresponding retention portion of said splitter to thereby retain said cutting member guard hood in said second position, another portion of said cutting member guard hood being positioned within said void in said table portion when said cutting member guard hood is in said second position, said cutting member guard hood thereby being prevented from assuming said second position when said table insert is positioned within said void in said table portion.

51. The cutting device of claim 50 wherein said retention portion of said cutting member guard hood is a projecting tab and wherein said corresponding retention portion of said splitter comprises a notch, said projecting tab enagagable with said notch when said table insert is removed from said void in said table portion.

52. The cutting device of claim 50 wherein said retention portion of said cutting member guard hood is a projecting tab and said corresponding retention portion of said splitter defines a notch, said projecting tab enagagable with said notch when said table insert is removed from said void in said table portion.

53. A cutting device comprising:

a table portion having a void therethrough and including a workpiece support surface defining a support surface plane;

a frame on which said table portion is mounted;

a table insert selectively positionable within said void and including a slot through which a driven cutting member extends, said table insert including a surface within said support surface plane when said table insert is disposed within said void; and a splitter and cutting member guard assembly mounted to the cutting device, said splitter and cutting member guard assembly comprising a splitter and a cutting member guard hood, said cutting member guard hood pivotally connected to said splitter and movable relative to said splitter between a first position, in which said cutting member guard hood covers an operative portion of the cutting member, and a second position, in which the operative portion of the cutting member is not covered by the cutting member guard hood, when said cutting member guard hood is in said second position, a retention portion of said cutting member guard hood releasably retainingly engages a corresponding retention portion on said splitter to thereby retain said cutting member guard hood in said second position, another portion of said cutting member guard hood extending through said table surface plane into said void when said cutting member guard hood is in said second position.

54. A cutting device comprising:

means for supporting a workpiece, said means for supporting including a first void therethrough;

means for bracing said means for supporting;

means for filling said first void removably supported within said first void and including a second void therethrough through which a driven cutting member may extend; and a splitter and cutting member guard assembly mounted on the cutting device comprising:

means for covering an operative portion of the driven cutting member rotatably mounted on the cutting device;

means for passing through a workpiece kerf, said means for passing through a workpiece kerf having a second retention means, said means for covering being mounted to said means for passing through and being pivotable between a first position, in which said means for covering covers the operative portion of the cutting member, and a second position, in which the operative portion of the cutting member is not covered by said means for covering, said means for covering having a first retention means in releasable retaining engagement with said second retention means when said means for covering is in said second position to thereby retain said means for covering in said second position, said first retention means prevented from engaging said second retention means when said means for filling is positioned within said first void in said means for supporting.

55. A splitter and cutting member guard assembly for mounting to a cutting device including a table portion, a void through the table portion, and a table insert removably supported within the void, the table insert having a slot therethrough through which a driven cutting member extends and being removable from the table portion to provide access through the table portion, the splitter and cutting member guard assembly comprising means for covering an operative portion of the cutting member, the splitter and cutting member guard assembly further comprising means for passing through a workpiece kerf, said means for covering being mounted to said means for passing and movable between a first position, in which said means for covering covers the operative portion of the circular cutting member, and a second position, in which the operative portion of the circular cutting member is exposed, said means for covering having a first retention means which releasably retainingly engages a second retention means on said means for passing to thereby retain said means for covering in said second position, said first retention means incapable of engaging said second retention means when said table insert is positioned within the void in the table portion.

* * * * *